US010378419B2

(12) United States Patent
Makino

(10) Patent No.: US 10,378,419 B2
(45) Date of Patent: Aug. 13, 2019

(54) WATER JACKET SPACER

(71) Applicant: UCHIYAMA MANUFACTURING CORP., Okayama-shi, Okayama (JP)

(72) Inventor: Koji Makino, Akaiwa (JP)

(73) Assignee: UCHIYAMA MANUFACTURING CORP., Okayama-Shi, Okayama (JP)

( * ) Notice: Subject to any disclaimer, the term of this patent is extended or adjusted under 35 U.S.C. 154(b) by 78 days.

(21) Appl. No.: 14/604,205

(22) Filed: Jan. 23, 2015

(65) Prior Publication Data

US 2015/0211409 A1 Jul. 30, 2015

(30) Foreign Application Priority Data

Jan. 27, 2014 (JP) ..... 2014-012033

(51) Int. Cl.
*F01P 3/02* (2006.01)
*F02F 1/10* (2006.01)
*F02F 1/14* (2006.01)

(52) U.S. Cl.
CPC ..... *F01P 3/02* (2013.01); *F02F 1/10* (2013.01); *F02F 1/14* (2013.01); *F02F 2001/104* (2013.01)

(58) Field of Classification Search
CPC ..... F01P 3/02; F02F 1/10; F02F 1/14; F02F 2001/104
USPC ..... 123/41.72, 41.79
See application file for complete search history.

(56) References Cited

U.S. PATENT DOCUMENTS 6,581,550 B2 * 6/2003 Shinpo ..... F01P 3/02 123/41.74
2008/0283001 A1 * 11/2008 Konishi ..... F02F 1/108 123/41.72

FOREIGN PATENT DOCUMENTS

| | | | |
|---|---|---|---|
| JP | 2002-013440 A | | 1/2002 |
| JP | 2005-256661 A | | 9/2005 |
| JP | 2005256661 A | * | 9/2005 |
| JP | 2007-263120 A | | 10/2007 |
| JP | 2009-243414 A | | 10/2009 |

* cited by examiner

*Primary Examiner* — Lindsay M Low
*Assistant Examiner* — Omar Morales
(74) *Attorney, Agent, or Firm* — Muncy, Geissler, Olds & Lowe, P.C.

(57) ABSTRACT

A water jacket spacer adjusting a flow amount of cooling water in a water jacket, the water jacket spacer being inserted in the water jacket of a cylinder block, the water jacket spacer has a spacer body and a rectification means inhibiting flow of cooling water to an inner wall on a cylinder bore side of the water jacket, the rectification means having a form of a pocket and being provided on a face of the spacer body, the face being on a side of a cooling water introduction port of the water jacket, the rectification means being provided lower than the cooling water introduction port in a depth direction.

10 Claims, 11 Drawing Sheets

*Fig.11a*
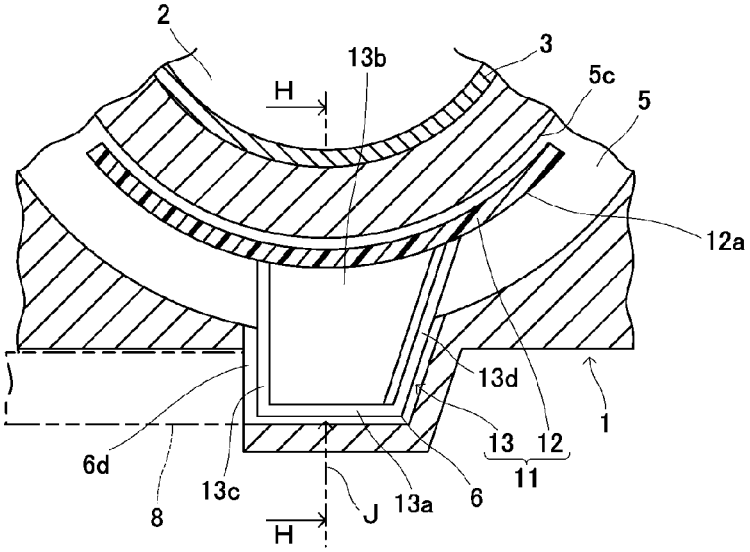
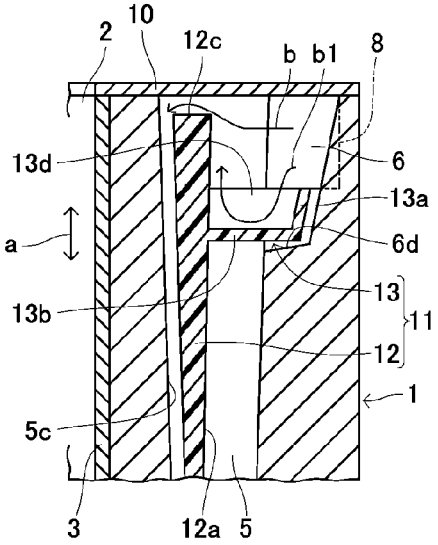
*Fig.11b*
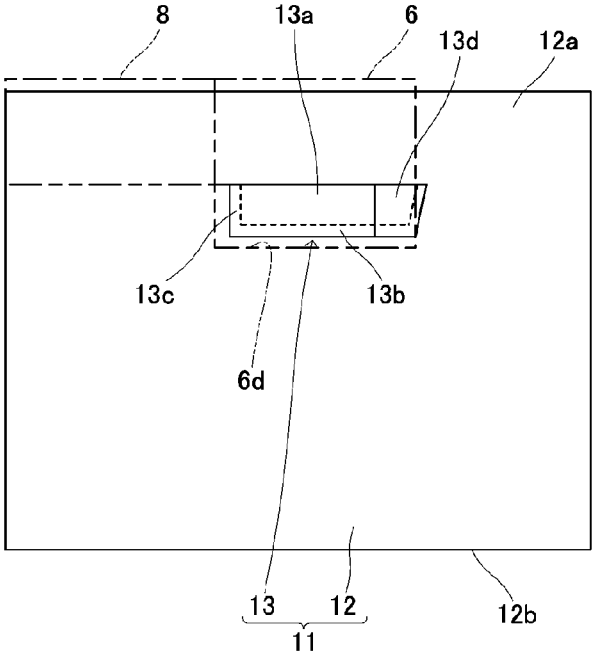
*Fig.11c*

*Fig.12a*
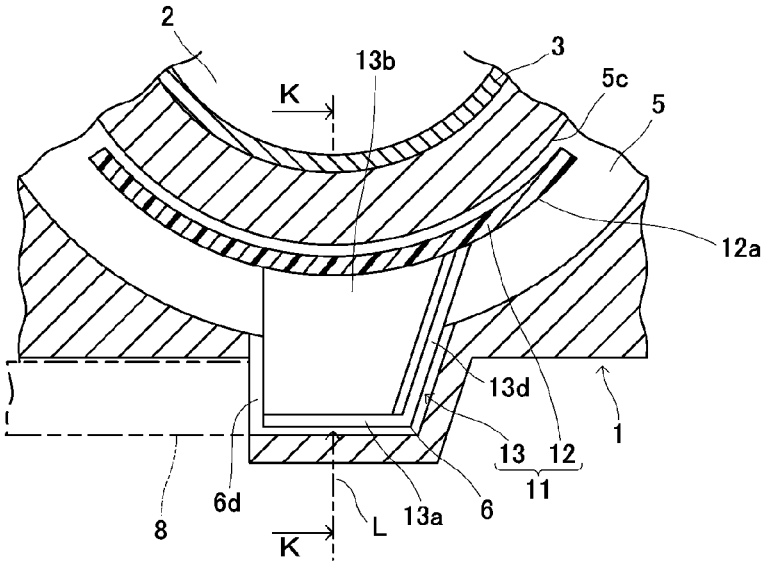
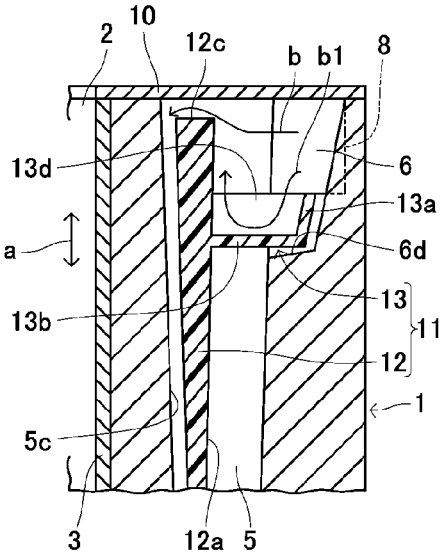
*Fig.12b*
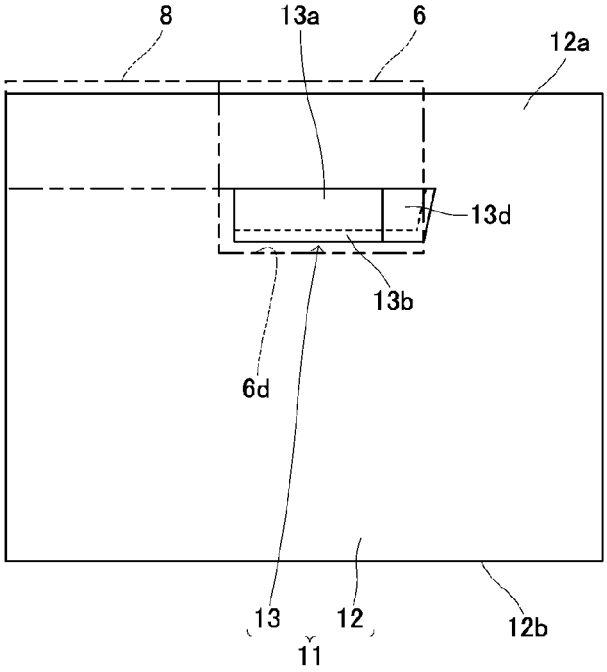
*Fig.12c*

WATER JACKET SPACER

TECHNICAL FIELD

The present invention relates to a water jacket spacer to be inserted in a water jacket of a cylinder block of a combustion engine.

BACKGROUND ART

A water jacket is formed around a cylinder bore of a cylinder block of a combustion engine, specifically a water-cooled engine; and cooling water, including cooling water mixed with antifreeze liquid, flows in the water jacket to cool a cylinder bore wall of which temperature increases while operating an engine. A water jacket spacer is inserted in the water jacket and appropriately cools the cylinder bore wall by adjusting the flow amount of cooling water, referring to the following Patent Literatures 1 and 2. Thus, appropriate cooling of the cylinder bore wall is done by the water jacket spacer. However, around a cooling water introduction port into the water jacket a lower portion of the cylinder bore wall is sometimes excessively cooled by the cooling water flowing into the back (on the cylinder bore side) of the water jacket spacer. When the lower portion of the cylinder bore wall opposite to the cooling water introduction port is excessively cooled, the viscosity of engine oil increases or the sliding resistance of a piston ring and a cylinder liner increases by deformation of the cylinder bore, thereby lowering energy efficiency. Patent Literatures 1 and 2 propose a structure for preventing excessive cooling of the cylinder bore wall around the cooling water introduction port (region opposite to the cooling water introduction port).

Patent literature 1 discloses, as a structure for preventing the above-mentioned excessive cooling, a seal structure for preventing water flow between the cylinder bore wall and the water jacket spacer, a structure in which the cylinder bore wall and the water jacket spacer are directly and firmly attached, a structure in which the water jacket spacer is energized or pressed against the cylinder bore wall and further discloses a structure in which the thermal conductivity of the cylinder bore wall around the cooling water introduction port is reduced. Patent Literature 2 discloses a structure in which an extending portion vertically along the cylinder bore wall is provided around the cooling water introduction port of the water jacket spacer and a portion bending from the extending portion is further provided, thereby inhibiting the flow of cooling water into the cylinder bore wall.

CITATION LIST

Patent Literature

PTL 1 JP-A-2005-256661
PTS 2 JP-A-2007-263120

SUMMARY OF INVENTION

Technical Problem

In the seal structure, the firmly attached structure, and the energizing or pressing structure disclosed in Patent Literature 1, the structure is not sometimes stably kept because of vibration and deterioration over time and the above-mentioned prevention effect of excessive cooling is not kept over time. When the thermal conductivity of the cylinder bore wall around the cooling water introduction port is reduced, the thermal conductivity of the cylinder block is required to be reduced. Such an operation may not be practical. In case of Patent Literature 2 inhibiting flow of cooling water, the extending portion and the peak may not sufficiently fulfill inhibition function of flow of cooling water.

The present invention is proposed in view of the above-mentioned problems and has an object to provide a water jacket spacer capable of effectively inhibiting excessive cooling of the cylinder bore wall around the cooling water introduction port with a simple structure.

Solution to Problem

In a water jacket spacer adjusting a flow amount of cooling water in a water jacket of the embodiment of the present invention, the water jacket spacer being inserted into the water jacket of a cylinder block, the water jacket spacer comprises a spacer body and a rectification means inhibiting flow of cooling water into an inner wall on a cylinder bore side of the water jacket, the rectification means having a form of a pocket and being provided on a face of the spacer body, the face being on a side of a cooling water introduction port of the water jacket, the rectification means being provided lower than the cooling water introduction port in a depth direction.

In the embodiment, cooling water inserted in the water jacket from the cooling water introduction port hits a face on the cooling water introduction port side of the spacer body, then part of cooling water enters and flows out of the rectification means in the form of a pocket, and circulates so as to diffuse along the spacer body upward in the depth direction of the water jacket. Therefore, the amount of cooling water flowing to the cylinder bore wall from a lower edge of the spacer body reduces and excessive cooling is effectively prevented at the lower portion of the cylinder bore wall facing the cooling water introduction port.

In the water jacket spacer of the above-mentioned embodiment, the rectification means can have a front wall portion, a bottom wall portion and at least one of a right side wall portion and a left side wall portion.

In the embodiment, the water flow direction of cooling water flowing downward in the depth direction of the water jacket is changed by the front wall, the bottom wall and one of the right and left side walls, thereby effectively inhibiting flow of cooling water to the cylinder bore wall side from the lower edge of the spacer body.

In the water jacket spacer as mentioned above, the rectification means can be provided in the vicinity of the cooling water introduction port.

In the embodiment, cooling water entering the water jacket from the cooling water introduction port is inhibited from communicating downward in the depth direction around the spacer body and the amount of cooling water flowing to the cylinder bore wall from the lower edge of the spacer body reduces. Therefore, excessive cooling is effectively prevented at the lower portion of the cylinder bore wall facing the cooling water introduction port.

In the water jacket spacer as mentioned above, a width of the rectification means, orthogonal to a depth direction of the water jacket and along a face on the cooling water introduction port side of the spacer body, can be greater than that of the cooling water introduction port.

In the embodiment, the amount of cooling water, entering from the cooling water introduction port and flowing downward in the depth direction of the water jacket, of which flow path is changed by the rectification means increases, thereby effectively preventing flow of cooling water to the cylinder bore wall and excessive cooling at the lower portion of the cylinder bore wall.

In the water jacket spacer as mentioned above, the rectification means is configured in such a manner that a part of the rectification means is located in the cooling water introduction port.

In the embodiment, before cooling water, entering from the cooling water introduction port and flowing downward in the depth direction of the water jacket, diffuses in the water jacket, the amount of cooling water of which flow path is changed upward by the rectification means increases, thereby effectively preventing flow of cooling water to the cylinder bore wall and excessive cooling at the lower portion of the cylinder bore wall.

In the water jacket spacer as mentioned above, the spacer body can be configured to cover a whole of the water jacket in a depth direction.

In the embodiment, the water jacket spacer is stably kept at a predetermined position in the depth direction of the water jacket. And the amount of cooling water flowing to the cylinder bore wall of the spacer body from the lower edge of the spacer body reduces.

Advantageous Effects of Invention

In the water jacket spacer of the present invention, excessive cooling at the cylinder bore wall around the cooling water introduction port can be effectively inhibited by a simple structure.

BRIEF DESCRIPTION OF DRAWINGS

FIG. 11*a* is a similar view to FIG. 4*a* and shows one modification of the above-mentioned embodiment in FIG. 10. FIG. 11*b* is a fragmentary view taken in the direction of the arrow H-H of FIG. 11*a*.

FIG. 11*c* is a fragmentary view of the water jacket spacer along the line J of FIG. 11*a*.

FIGS. 12*a-c* show a further modification of FIGS. 11*a-c*. FIG. 12*a* is a similar view to FIG. 11*a*, FIG. 12*b* is a fragmentary view taken in the direction of the arrow K-K of FIG. 12*a*, and FIG. 12*c* is a fragmentary view of the water jacket spacer along the line L of FIG. 12*a*.

DESCRIPTION OF EMBODIMENTS

Figure 1:
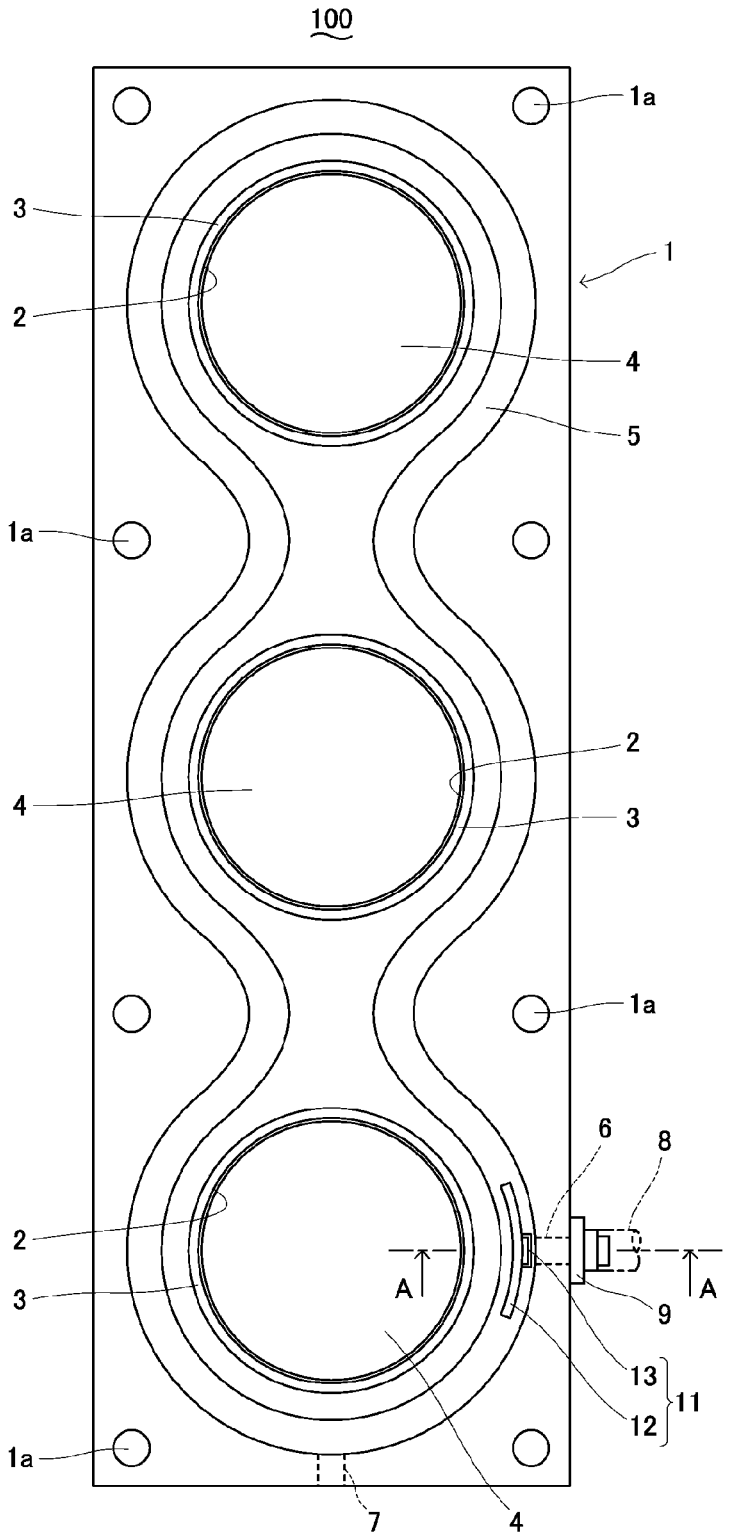
FIG. 1 is a plan view diagrammatically showing an embodiment of a cylinder block for an automotive engine to which a water jacket spacer of one aspect of the present invention is applied.
Figure 2:
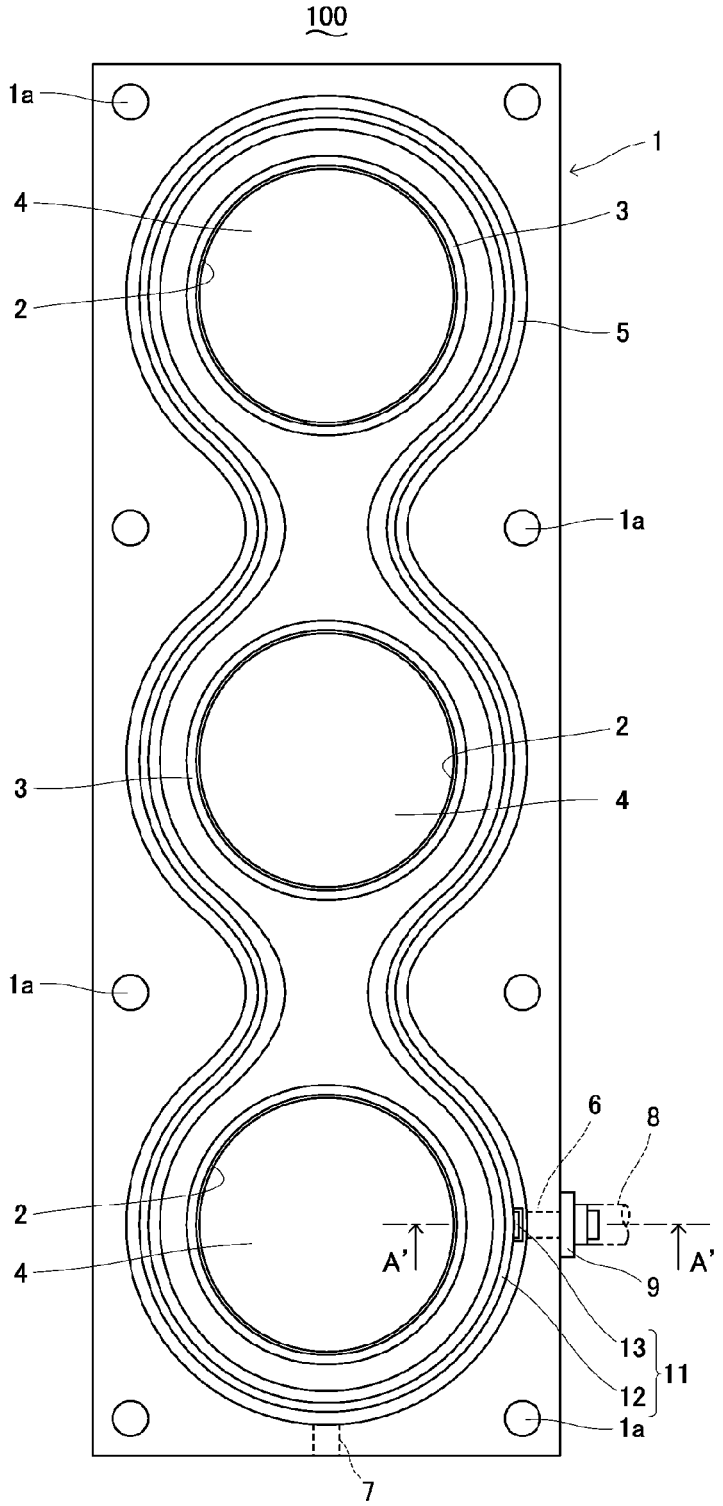
FIG. 2 is a similar view to FIG. 1 and shows another water jacket spacer of another aspect of the present invention.
Figure 3:
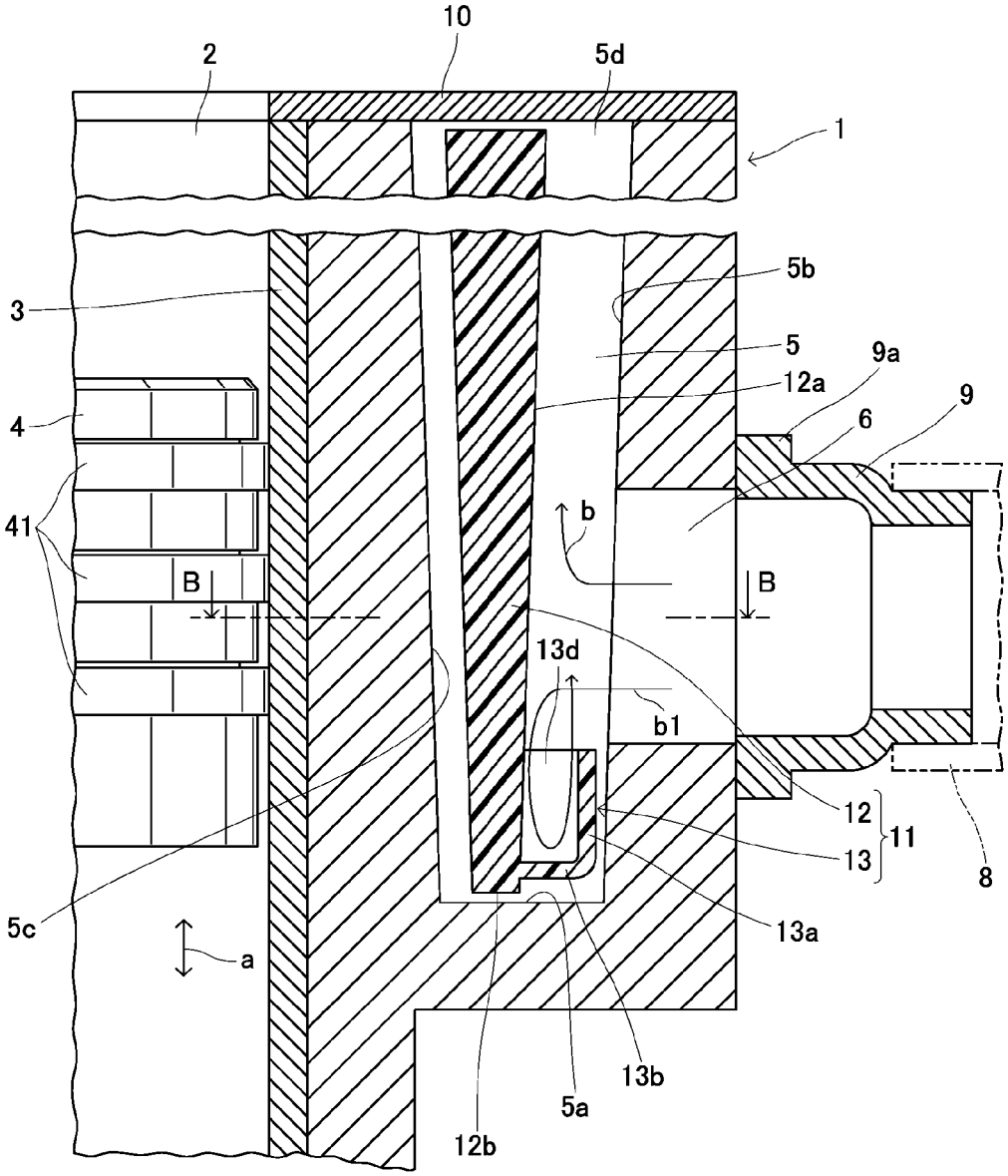
FIG. 3 shows the first embodiment of the water jacket spacer of one aspect of the present invention and is an enlarged sectional view taken in the directions of the arrow along the line A-A of FIG. 1 and the arrow along the line A'-A' of FIG. 2.

The embodiment of the present invention is explained referring to the attached drawings. FIG. 1 is a plan view diagrammatically showing an embodiment of a cylinder block for an automotive engine to which a water jacket spacer of one aspect of the present invention is applied. FIG. 2 shows a water jacket spacer of another aspect of the present invention. The water jacket spacer in FIG. 1 is a partial spacer partially inserted in a water jacket and is positioned so as to face a cooling water introduction port. The water jacket spacer in FIG. 2 is formed around the whole shape of the annular water jacket and is inserted into the entire water jacket. FIG. 3 shows the first embodiment of the water jacket spacer of one aspect of the present invention and is an enlarged sectional view taken in the directions of the arrow along the line A-A of FIG. 1 and the arrow along the line A'-A' of FIG. 2. The embodiment in FIG. 3 is explained as an embodiment in common with the water jacket spacers shown in FIG. 1 and FIG. 2.

A cylinder block 1 shown in FIG. 1, FIG. 2 and FIG. 3 constitutes a three-cylinder automotive engine 100 (internal-combustion engine) and three cylinder bores 2 . . . are serially arranged. The reference numerals 1*a* . . . refer to holes for inserting bolts, not shown in the figure, for integrally fastening a cylinder head (not shown in the figure) with the cylinder block 1. A cylinder liner 3 is integrally fitted to the inside of the cylinder bore 2 and a piston 4 is housed in the cylinder liner 3 so as to slidably reciprocate along the axial direction (direction shown with an arrow "a"). A plurality of piston rings 41 . . . which contact the inside of the cylinder liner 3 are fitted to the circumference of the piston 4 in such a manner that the piston 4 smoothly slides with the inside of the cylinder liner 3 together with the piston rings 41 via engine oil, not shown in the figure. An open-deck type water jacket 5 is serially provided around three cylinder bores 2 . . . and the cylinder block 1 is provided with a cooling water introduction port 6 (cooling water includes antifreeze liquid) and a cooling water discharge port 7 which communicates with the water jacket 5. The cooling water discharge port 7 is connected to a radiator, not shown in the figure, with a pipe and the outlet side of the radiator is connected to the cooling water introduction port 6 via a water pump (not shown in the figure) with a pipe. Thereby, the cooling water circulates between the water jacket 5 and the radiator. A socket 9 for connecting a pipe line 8 for circulation is attached with bolts, not shown in the figure, to the cooling water introduction port 6 via a flange portion 9*a*. A similar socket, not shown in the figure, is provided for the cooling water discharge port 7.

When a water jacket is provided for a cylinder head, the water jacket 5 of the cylinder block 1 is designed to communicate with the water jacket of the cylinder head. In such a case, the cooling water discharge port 7, not necessary for the cylinder block 1, is provided for the cylinder head and is connected with a pipe line to the radiator. The term "upper" in the following explanation means the forward side of the sheet of FIG. 1 or FIG. 2, namely on the open side of the water jacket. The term "lower" means the back side of the sheet of FIG. 1 or FIG. 2, namely the bottom side, on the opposite side to the opening of the water jacket. In FIG. 3, the term "upper" is the upper side on the sheet of the drawing along the arrow "a" and the term "lower" is the lower side on the sheet of the drawing along the arrow "a". The arrow "a" corresponds to the depth direction of the water jacket 5 and is referred to as the "depth direction a".

The water jacket 5 is an open-deck type with the upper end open and is constituted with a bottom portion 5*a*, an outer wall 5*b* and an inner wall 5*c* (a cylinder bore wall) on the cylinder bore 2 side. The upper end opening portion 5*d* is sealed by a cylinder head gasket 10 provided between the cylinder block 1 and the cylinder head, not shown in the figure. A water jacket spacer 11 is inserted into the water jacket 5 from the upper end opening portion 5*d*. The water jacket spacer 11 shown in FIG.1 is a non-annular partial spacer inserted to a position opposite to the cooling water introduction port 6 in the water jacket 5. The water jacket spacer 11 shown in FIG.2 is an annular spacer around the shape of the water jacket 5. The water jacket spacer 11 in the figures has a spacer body 12 constituted with a molded resin body and a rectification means 13 in the shape of a recessed region or pocket which is provided on the outer surface 12*a* of the spacer body 12 facing the cooling water introduction port 6 of the water jacket 5 close to and under the lower portion of the cooling water introduction port 6. The spacer body 12 and the rectification means 13 are integrally molded with the same resin. In the figure, the spacer body 12 is provided so as to entirely extend in the depth direction "a" from the upper end opening portion 5*d* to the bottom portion 5*a* of the water jacket 5. However, the upper end of the spacer body 12 is required to be positioned above the upper edge of the cooling water introduction port 6.

Figure 4A:
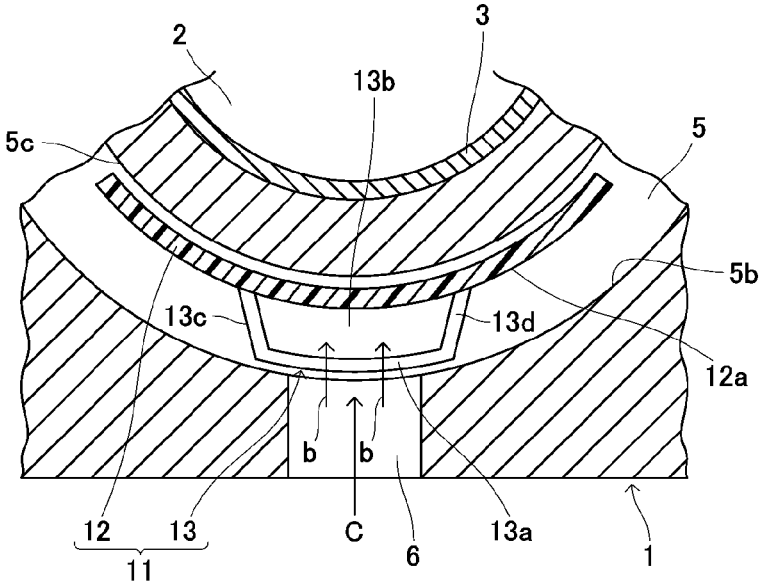
FIG. 4*a* is a fragmentary view taken in the direction of the arrow along the line B-B of FIG. 3
Figure 4B:
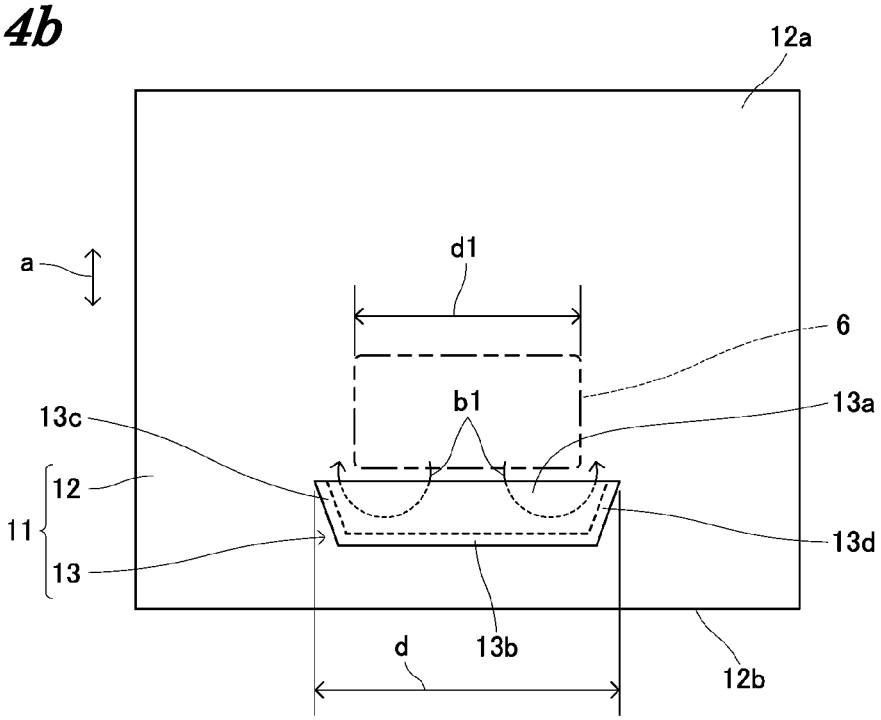
FIG. 4*b* is a fragmentary view of the water jacket spacer along the line C of FIG. 4*a*.

The water jacket spacer 11 of the embodiment is detailed also referring to FIG. 4*a* and FIG. 4*b*. The water jacket spacer 11 shown in FIG. 4*a* and FIG. 4*b* is a partial spacer; however, the following explanation is in common with the annular spacer shown in FIG. 2. The rectification means 13 in the form of a pocket constituting the water jacket spacer 11 is positioned in the vicinity of the lower end of the cooling water introduction port 6, has a front wall 13*a*, a bottom wall 13*b*, a left side wall 13*c* and a right side wall 13*d*, and is formed like a box of which upper end is open. The length "d" of the rectification means 13, which is perpendicular to the depth direction "a" of the water jacket 5 and is around a surface 12*a* (referred to as an outer surface hereinafter) on the side of the cooling water introduction port 6 of the spacer body 12, is larger than the corresponding length dl of the cooling water introduction port 6. The upper opening of the rectification means 13 is formed larger than the bottom wall 13*b* so as to expand in the width direction. A two-dotted line in FIG. 4*b* shows the shape of the open edge portion on the side of the water jacket 5 of the cooling water introduction port 6. The bottom wall 13*b* of the rectification means 13 extends from the outer surface 12*a* so as to be perpendicular to the outer surface 12*a* and the depth direction "a". The side walls 13*c*, 13*d* are substantially perpendicular to the outer surface 12*a* and extend upward from the left and right ends of the bottom wall 13*b*, respectively. The front wall 13*a* is connected to the bottom wall 13*b* and the side walls 13*c*, 13*d* and is positioned so as to face the outer surface 12*a*. The side walls 13*c*, 13*d* incline so as to reduce the facing width toward the bottom wall 13*b*. The upper edges of the front wall 13*a* and the side walls 13*c*, 13*d* are desirably positioned close to and under the lower side of the open edge portion on the side of the water jacket 5 of the cooling water introduction port 6. However, the upper edges can be at the same position as the lower side or slightly project upward. The front wall 13*a* stands perpendicular to the bottom wall 13*b* in the figure; however, the front wall 13*a* can stand obliquely so as to widen the upper end portion of the rectification means 13.

In the cylinder block 1 into which the above-mentioned water jacket spacer 11 is inserted, cooling water is introduced in the water jacket 5 from a circulation pipe 8 through the socket 9 and the cooling water introduction port 6 as shown with the arrow "b". The cooling water introduced in the water jacket 5 hits the outer surface 12*a* of the spacer body 12 and diffuses in the water jacket 5 around the outer surface 12*a*. The cooling water diffusing in the water jacket 5 inhibits temperature increase of the cylinder bore wall 5*c*. The cooling water flowing sideward or upward in the depth direction "a" flows into the back side of the spacer body 12 and cools down the cylinder bore wall 5*c* on the combustion chamber side. A part of the cooling water hits the outer surface 12*a* of the spacer body 12 and also flows into the pocket-like space of the rectification means 13, then flows out of the water rectification means 13 and diffuses and circulates upward in the depth direction "a" in the water jacket 5 around the spacer body 12, as shown in the arrow b1. Therefore, the amount of the cooling water flowing to the cylinder bore wall 5*c* from a lower edge 12*b* of the spacer body 12 reduces, thereby effectively inhibiting excessive cooling of the lower portion of the cylinder bore wall 5*c* facing the cooling water introduction port 6.

In this embodiment, the length "d" in the width direction of the rectification means 13 is larger than the length dl in the width direction of the cooling water introduction port 6. Therefore, most of the cooling water flowing downward from the cooling water introduction port 6 flows to the rectification means 13 and circulates as shown in the direction of the arrow b1, thereby effectively inhibiting flow of the cooling water to the cylinder bore wall 5*c* as mentioned above. The amount of the cooling water, flowing downward in the depth direction "a" of the water jacket 5, of which flow path is changed by the rectification means 13 increases. The cooling water diffuses and circulates in the water jacket 5 and is discharged from the discharge port 7 toward the radiator. While the cooling water circulates in the water jacket 5, the cylinder bore wall 5*c*, which is required to be cooled, at the upper portion of the cylinder block 1 (on a side close to the cylinder head, namely on the side of the combustion chamber) is appropriately cooled, thereby inhibiting excessive cooling of the lower portion of the cylinder bore wall 5*c*. Therefore, the cylinder liner 3 is not deformed and the piston 4 smoothly moves up and down. The spacer body 12 is formed so as to extend the entire depth direction "a" of the water jacket 5, so that the water jacket spacer 11 is stably held at a predetermined position in the depth direction "a" of the water jacket 5. In addition, the amount of the cooling water flowing to the cylinder bore wall 5*c* of the spacer body 12 from the lower edge 12*b* of the spacer body 12 reduces.

Figure 5A:
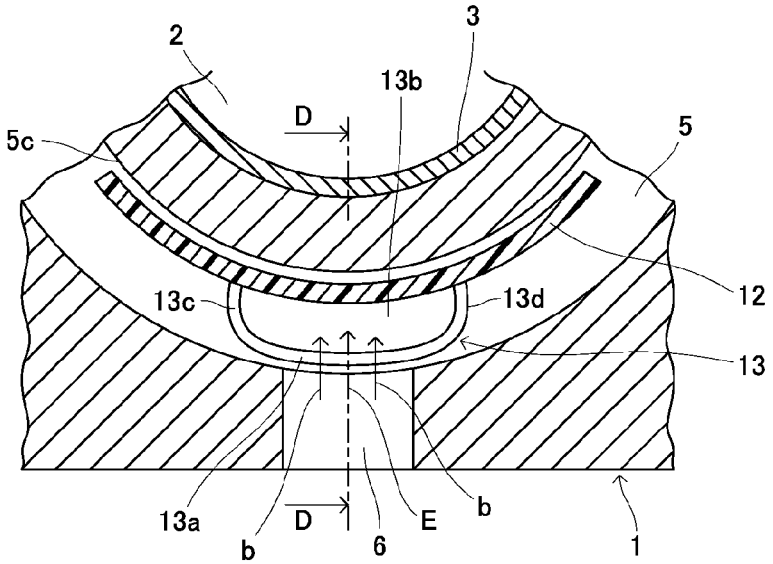
FIG. 5*a* is a similar view to FIG. 4*a* and shows one modification of the above-mentioned embodiment.
Figure 5B:
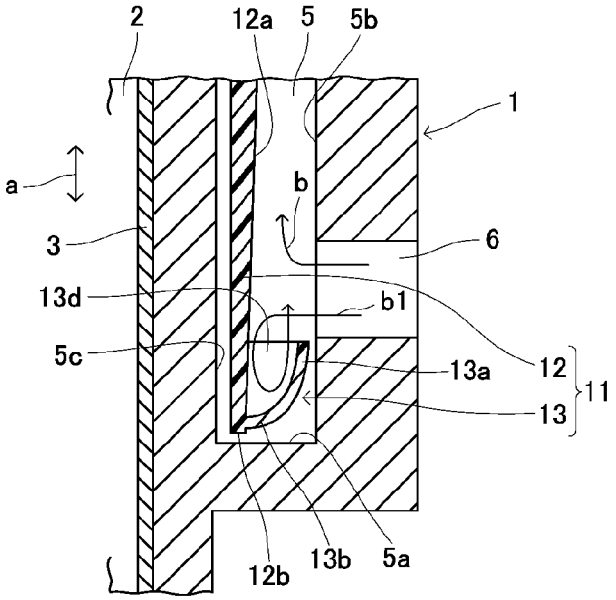
FIG. 5*b* is a fragmentary view taken in the direction of the arrow D-D of FIG. 5*a*.
Figure 6:
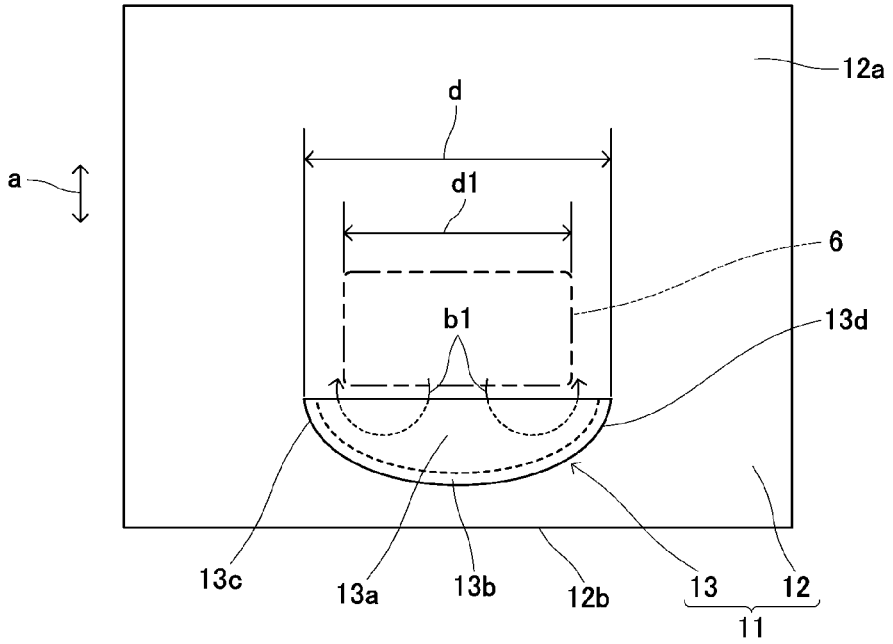
FIG. 6 is a fragmentary view of the water jacket spacer along the line E of FIG. 5*a*.

FIG. 5*a*, FIG. 5*b* and FIG. 6 show one modification of the above-mentioned embodiment. The members in common with the embodiments shown in FIG. 3 and FIGS. 4*a*-*b* are allotted with the same reference numerals and some members are not explained hereinafter.

In the modification shown in FIG. 5*a*, FIG. 5*b* and FIG. 6, the pocket-like rectification means 13 has the front wall 13*a*, the bottom wall 13*b* and the side walls 13*c*, 13*d*, and is formed like a box of which upper end is open as shown in the above-mentioned embodiment. However, the front wall 13*a*, the bottom wall 13*b* and side walls 13*c*, 13*d* are curved planes, being different from the embodiment shown in FIG. 3 and FIGS. 4*a-b*. Also in this modification, the rectification means 13 functions as mentioned in the above embodiment such that most of the cooling water flowing downward from the cooling water introduction port 6 flows into the rectification means 13 and circulates as shown in the direction of the arrow b1, thereby effectively reducing the amount of the cooling water flowing to the cylinder bore wall 5*c* from the lower edge 12*b* of the spacer body 12. In addition, the cooling water which enters the rectification means 13 and of which the flow direction is changed smoothly circulates as the front wall 13*a*, the bottom wall 13*b* and side walls 13*c*, 13*d* are curved.

Figure 7:
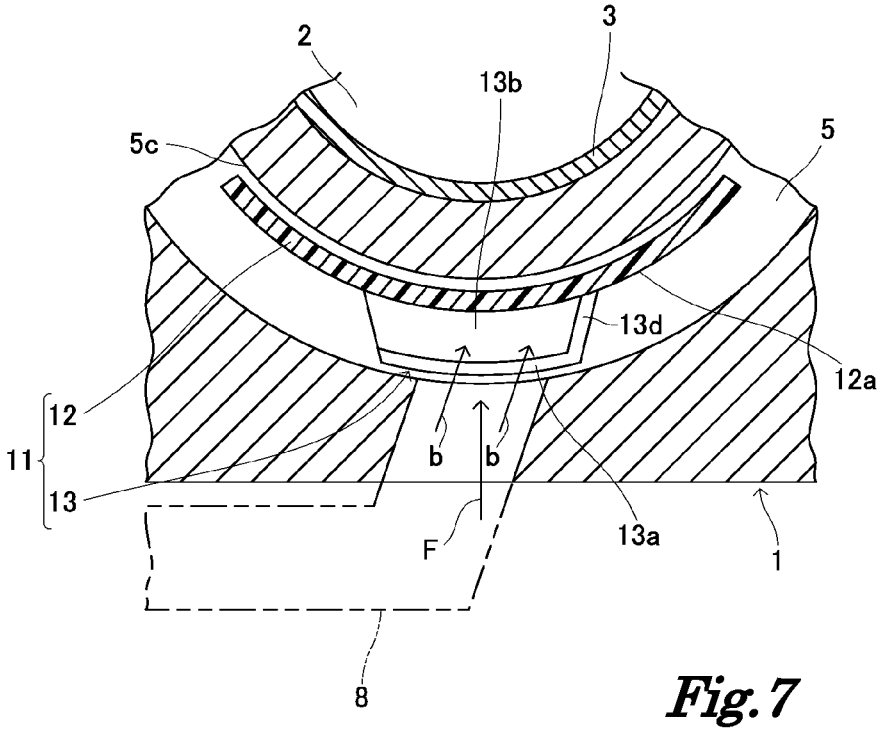
FIG. 7 is a similar view to FIG. 4*a* and shows another modification of the above-mentioned embodiment.
Figure 8A:
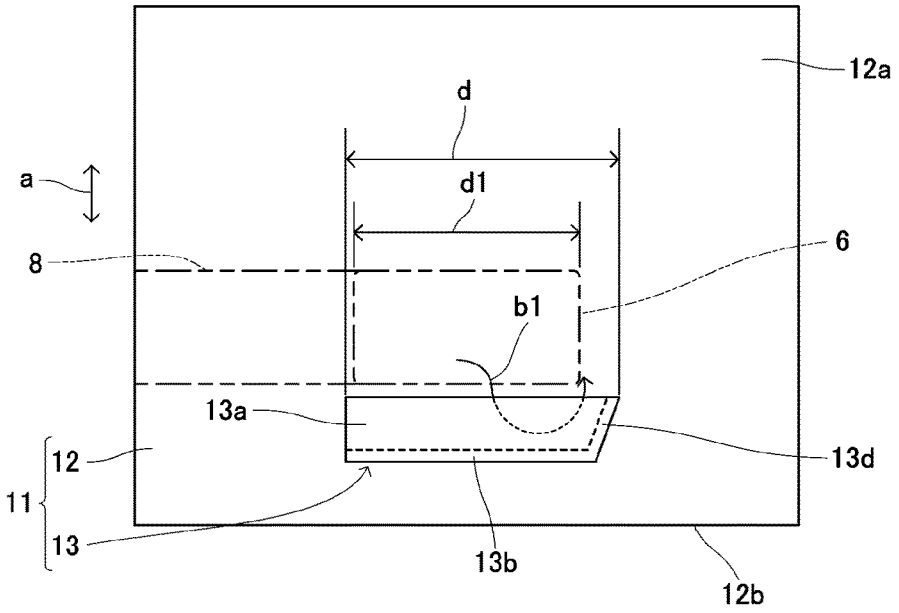
FIG. 8*a* is a fragmentary view of the water jacket spacer along the line F of FIG. 7.
Figure 8B:
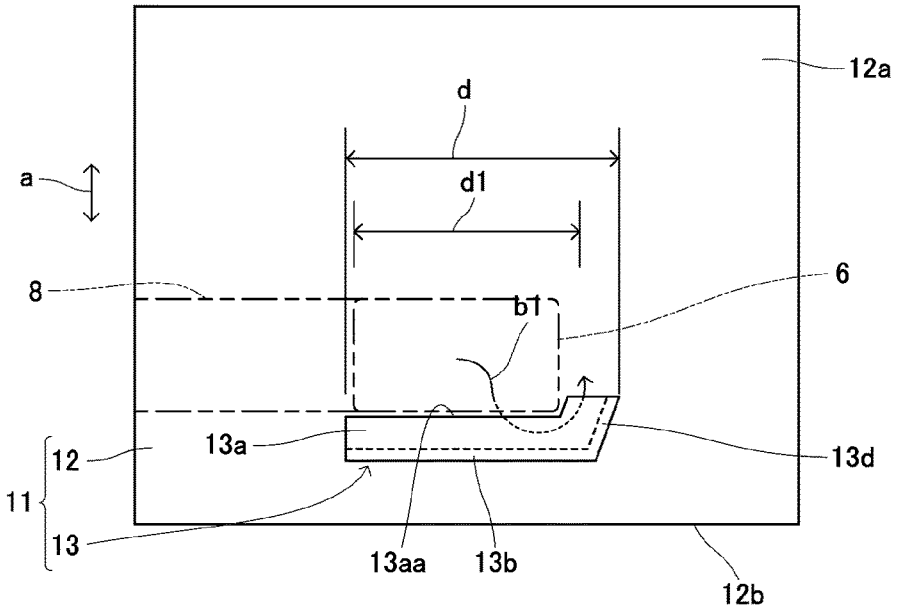
FIG. 8*b* shows a modification of FIG. 8*a*.

FIG. 7, FIG. 8*a* and FIG. 8*b* show another modification of the above-mentioned embodiment. In this modification, the circulation pipe 8 of the cooling water is provided along the outer surface of the cylinder block 1 and is connected to the cooling water introduction port 6 via the socket (not shown in FIG. 7, FIG. 8*a* and FIG. 8*b*, referring to FIG. 1 to FIG. 3). The flow center of the cooling water introduction port 6 is oblique relative to the cylinder block 1 on a planar view. Namely, the flow direction of the cooling water is oblique along the flow center of the cooling water introduction port 6 as shown in the direction of the arrow "b". The pocket-like rectification means 13 has the front wall 13*a*, the bottom wall 13*b* and the right wall 13*d*; however, the left wall 13*c*, referring to FIG. 3 and FIGS. 4*a-b*, is not provided. In the modification of FIG. 8*b*, the rectification means 13 is constituted in such a manner that the cooling water introduction port 6 is positioned close to and above a cutout portion 13*aa* formed on the upper side of the front wall 13*a*. In the modification a part of the cooling water obliquely introduced flows into the rectification means 13; however most of the cooling water entering the rectification means 13 flows out of the rectification means 13 along the front wall 13*a*, the bottom wall 13*b* and the right wall 13*d*, diffuses and circulates upward around the spacer body 12 in the depth direction "a" in the water jacket 5, as shown with the arrow b1. The amount of the cooling water flowing to the cylinder bore wall 5*c* from the lower edge 12*b* of the spacer body 12 reduces, thereby efficiently inhibiting excessive cooling of the lower portion of the cylinder bore wall 5*c* facing the cooling water introduction port 6. In such a case, as the cooling water is introduced obliquely, the same rectification function of the cooling water as mentioned above is achieved even if the left side wall 13*c* is not provided. If the right and left side walls 13*c*, 13*d* are provided as shown in FIG. 3 and FIGS. 4*a-b*, further rectification function is fulfilled. The left wall 13*c* is not provided in the figures; however, the right wall 13*d* may not be provided depending on the direction of the flow center of the cooling water introduction port 6.

Figure 9A:
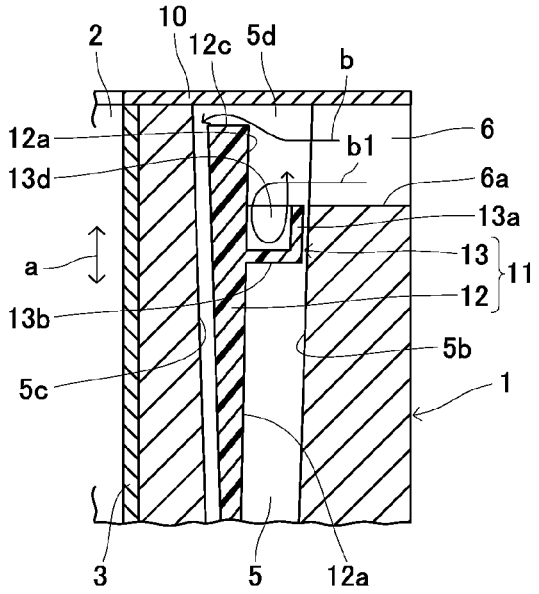
FIG. 9*a* and FIG. 9*b* show another example in common with the modifications of the above-mentioned embodiment and are similar views to FIG. 5*b*.
Figure 9B:
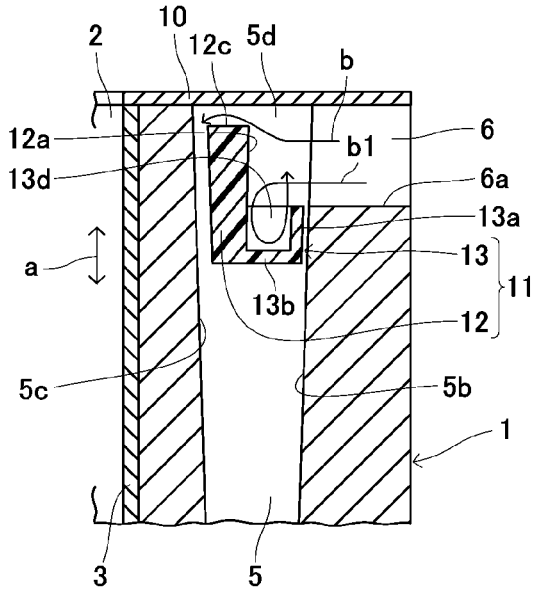

FIG. 9*a* and FIG. 9*b* show another example in common with the first embodiment. In the example, the cooling water introduction port 6 is constituted with a cutout concave 6*a* formed on the upper end of the engine block 1 and the cylinder head gasket 10. The pocket-like rectification means 13 constituting the water jacket spacer 11 is provided close to and under the cooling water introduction port 6 as described in the embodiments shown in FIG. 3 and FIGS. 4*a-b*. The rectification means 13 has the front wall 13*a*, the bottom wall 13*b* and the right and left side walls 13*c*, 13*d* and is formed like a box of which upper end is open. The left side wall 13*c* is not shown in the figure. The left side wall 13*c* is not necessary when the cooling water introduction port 6 is formed obliquely on a planar view, as shown in the embodiment of FIG. 7.

In the example of FIG. 9*a*, the spacer body 12 is formed so as to extend substantially along the depth direction "a" of the entire water jacket 5 from the upper end opening portion 5*d* to the bottom portion 5*a*, referring to FIG. 3. In the example of FIG. 9*b*, the spacer body 12 is designed to be positioned only at the upper portion in the water jacket 5. In the examples, the cooling water introduced into the water jacket 5 from the cooling water introduction port 6 hits the outer surface 12*a* of the spacer body 12, diffuses in the water jacket 5 around the outer surface 12*a*, and flows into the back side of the spacer body 12 from the upper edge 12*c* of the spacer body 12 as shown in the arrow "b". Thereby, the cylinder bore wall 5*c* on the combustion chamber side is efficiently cooled. A part of the cooling water hits the outer surface 12*a* of the spacer body 12 and also flows into the pocket-like space of the rectification means 13. Then the cooling water flows out of the rectification means 13 and diffuses and circulates upward in the depth direction "a" in the water jacket 5 around the spacer body 12. Thereby, the amount of the cooling water flowing downward in the water jacket 5 reduces and excessive cooling of the lower portion of the cylinder bore wall 5*c* facing the cooling water introduction port 6 is effectively inhibited.

The rectification means 13 in the examples can be replaced with the rectification means 13 shown in FIGS. 5*a-b*, 6, 7, and 8*a-b*.

Figure 10A:
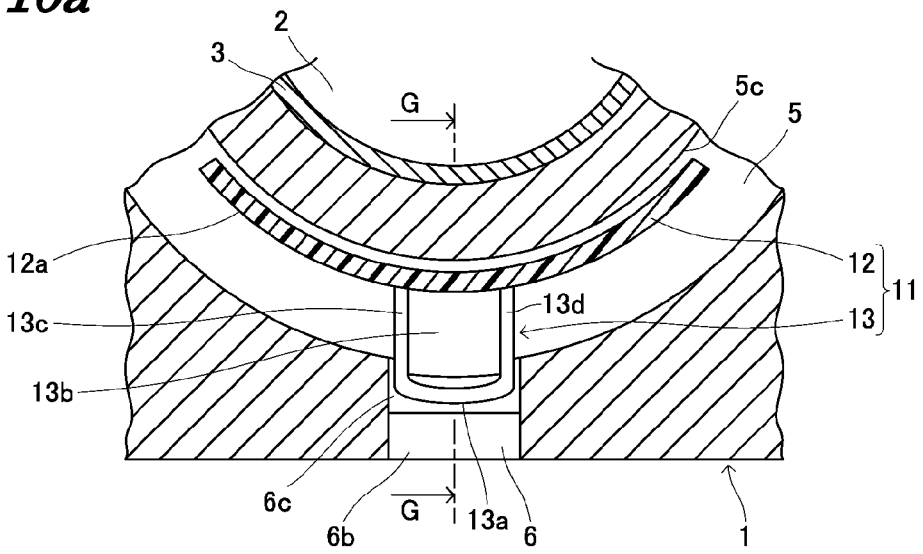
FIG. 10*a* is a similar view to FIG. 4*a* and shows the second embodiment of the water jacket spacer of one aspect of the present invention.
Figure 10B:
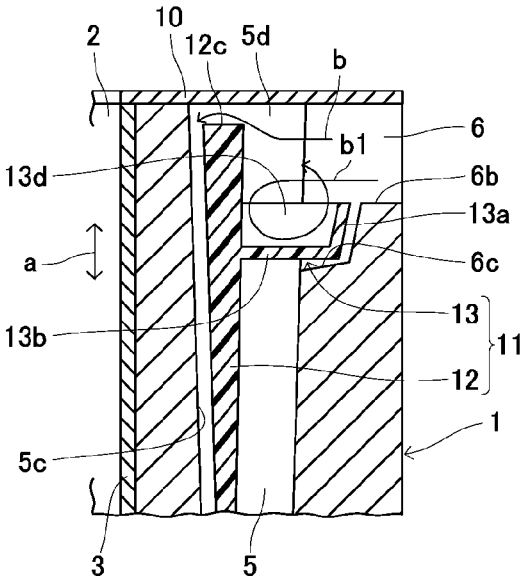
FIG. 10*b* is a fragmentary view taken in the direction of the arrow G-G of FIG. 10*a*.

FIGS. 10*a-b* show the second embodiment of the water jacket spacer of the present invention. FIGS. 11*a-c* show a modification of the embodiment and FIGS. 12*a-c* show a modification of the embodiment in FIGS. 11*a-c*. In the embodiments and the modifications, apart of the rectification means 13 is located so as to be embedded in a part of the cooling water introduction port 6.

In the modification of FIG. 10*a* and FIG. 10*b*, stepped cutout concaves 6*b*, 6*c* are formed on the upper end portion of the cylinder block 1. The cutout concaves 6*b*, 6*c* and the cylinder head gasket 10 constitute the cooling water introduction port 6. The cutout concave 6*c* is positioned on the side of the water jacket 5 and is lower than the cutout concave 6*b*. The water jacket spacer 11 in this embodiment is comprised of the spacer body 12 constituted with a resin molded body and the pocket-like rectification means 13 integrated with the spacer body 12 as mentioned above. The rectification means 13 is provided on the side of the outer surface 12*a* of the spacer body 12 facing the cooling water introduction port 6 of the water jacket 5 close to and under the cooling water introduction port 6 (in the lower half of the cooling water introduction port 6). The rectification means 13 has the front wall 13*a*, the bottom wall 13*b* and the side walls 13*c*, 13*d*, and is formed like a box of which upper end is open. A part of the leading end of the rectification means 13 is designed to be embedded in the cooling water introduction port 6, namely in the cutout concave 6*c* constituting the cooling water introduction port 6.

In the cylinder block 1 into which the above-mentioned water jacket spacer 11 is inserted, the cooling water is introduced into the water jacket 5 from the cooling water introduction port 6 as shown with the arrow "b". The cooling water introduced into the water jacket 5 hits the outer surface 12*a* of the spacer body 12, diffuses in the water jacket 5 around the outer surface 12*a*, and flows into the back side of the spacer body 12 from the upper edge 12*c* of the spacer body 12. Thus, the cylinder bore wall 5*c* on the combustion chamber side is efficiently cooled. A part of the cooling water hits the outer surface 12*a* of the spacer body 12 and also flows into the pocket-like space of the rectification means 13, as shown with the arrow bl. Then the cooling water flows out of the rectification means 13, and diffuses and circulates upward in the depth direction "a" in the water jacket around the spacer body 12. A part of the rectification means 13 is formed so as to be embedded in the cooling water introduction port 6, so that the pocket-like space is widely formed and the amount of cooling water flowing into the rectification means 13 increases. In addition, the cooling water flows into the rectification means 13 before flowing into the water jacket 5, thereby further effectively achieving the rectification function.

As other structures are the same as those in the above-mentioned embodiment, the same reference numerals are allotted to the common members and the explanation thereof is omitted here.

In the example shown in FIG. 11*a,* FIG. 11*b* and FIG. 11*c,* the circulation pipe 8 of the cooling water is provided around the outer surface of the cylinder block 1 and a part of the cylinder block 1 to which the cooling water introduction port 6 is provided is designed to expand outward. The cooling water introduction port 6 is constituted with the cutout concave 6*d* formed on the upper end portion of the cylinder block 1 and the cylinder head gasket 10. The circulation pipe 8 is connected to the cooling water introduction port 6 via the socket 9 (not shown in FIGS. 11*a-c,* referring to FIG. 1 to FIG. 3). The cutout concave 6*d* constituting the cooling water introduction port 6 is provided in the form of a step lower than the circulation pipe 8 where the cutout concave 6*d* and the circulation pipe 8 are connected. The water jacket spacer 11 in the example comprises the spacer body 12 constituted with the resin molded body and the pocket-like rectification means 13 integrated with the spacer body 12 as mentioned above. The rectification means 13 is provided on the side of the outer surface 12*a* of the spacer body 12 facing the cooling water introduction port 6 of the water jacket 5 close to and under the cooling water introduction port 6 (in the lower half of the cooling water introduction port 6). The rectification means 13 has the front wall 13*a,* the bottom wall 13*b* and the right and the left side walls 13*c,* 13*d,* and is formed like a box of which upper end is open. A part of the leading end of the rectification means 13 is designed to be embedded in the cooling water introduction port 6, namely in the cutout concave 6*d.*

In the cylinder block 1 into which the above-mentioned water jacket spacer 11 is inserted, the cooling water is introduced into the water jacket 5 from the cooling water introduction port 6 as shown with the arrow "b". The cooling water introduced into the water jacket 5 hits the outer surface 12*a* of the spacer body 12, diffuses in the water jacket 5 around the outer surface 12*a,* and flows into the back side of the spacer body 12 from the upper edge 12*c* of the spacer body 12. Thus, the cylinder bore wall 5*c* on the combustion chamber side is efficiently cooled. A part of the cooling water flows into the pocket-like space of the rectification means 13 as shown with the arrow b1. Then the cooling water flows out of the rectification means 13, and diffuses and circulates upward in the depth direction "a" in the water jacket 5 around the spacer body 12. A part of the rectification means 13 is formed so as to be embedded in the cooling water introduction port 6, so that the pocket-like space is widely formed and the amount of cooling water flowing into the rectification means 13 increases. In addition, the cooling water flows into the rectification means 13 before flowing into the water jacket 5, thereby further effectively achieving the rectification function, as mentioned in the example shown in FIGS. 10*a-b.*

The example shown in FIG. 12*a,* FIG. 12*b* and FIG. 12*c* is a modification of the embodiment of FIGS. 11*a-c.* The left side wall 13*c* constituting the rectification means 13 is not provided and other structures are the same as those in FIGS. 11*a-c,* referring to FIGS. 11*a-c.* In this modification, as the left side wall 13*c* is not provided, the cooling water flowing from the circulation pipe 8 easily flows into the rectification means 13, thereby effectively achieving the above-mentioned function of the rectification means 13.

As other structures are the same as those of the embodiment in FIGS. 11*a-c,* the same reference numerals are allotted to the common members and the explanation thereof is omitted here. The cutout 13*aa* as shown in FIG. 8*b* can be provided for the front wall 13*a* of the rectification means 13 in the modifications shown in FIGS. 11*a-c* and FIGS. 12*a-c.*

The three-cylinder automotive engine 100 is exemplified as an internal engine to which the water jacket spacer of the present invention is applied. However, the water jacket spacer can be applied to any automotive engine other than the three-cylinder automotive engines or an internal combustion engine used for other than an automobile. The position of the cooling water introduction port 6 of the cylinder block 1 is not limited to the embodiment in FIG. 1 and can be positioned anywhere in the circumferential direction of the water jacket 5. The position in the height (depth) direction of the cooling water introduction port 6 is not limited to the bottom side or the upper side as shown in the figures and can be in the middle thereof depending on the specification of the internal engine. The cylinder bore wall 5*c* at the lower portion of the water jacket 5 in the depth direction "a" is easily excessively cooled or the water jacket 5 from the middle portion to the lower portion is excessively cooled depending on the specification of the engine. Therefore, the rectification means 13 is appropriately positioned depending on the specification of the engine. The sectional shape of the cooling water introduction port 6 is square in the figures; however, the present invention is not limited to such an embodiment and the sectional shape can be circular, oblong or of other shapes.

The rectification means 13 is constituted with a resin molded body integrated with the spacer body 12 in the above-mentioned embodiment; however, the material is not limited to resin and can be made of metal and integrated with the spacer body 12. The shape of the rectification means 13 is not limited to those shown in figures and can be of other shapes as long as they are formed like a pocket.

REFERENCE SIGNS LIST

1 cylinder block
2 cylinder bore
5 water jacket
5*c* cylinder bore wall (inner wall on cylinder bore side)
6 cooling water introduction port
11 water jacket spacer
12 spacer body
13 rectification means
13*a* front wall
13*b* bottom wall
13*c* left side wall
13*d* right side wall a depth direction d length in width direction of rectification means d1 length in width direction of cooling water introduction port

The invention claimed is:

1. A water jacket spacer adjusting a flow amount of cooling water in a water jacket, the water jacket spacer being inserted into the water jacket of a cylinder block, the water jacket spacer comprising:

a spacer body; and a rectification portion inhibiting flow of cooling water to an inner wall on a cylinder bore side of the water jacket, the rectification being provided on an outer face of the spacer body so as to project from the outer face of the spacer body to a cooling water introduction port side and being provided lower than the cooling water introduction port in a depth direction, the rectification portion having a front wall portion, a bottom wall portion, a right side wall portion, a left side wall portion, and an open upper end to form a box-like pocket, the bottom wall portion being formed so as to project from the outer face of the spacer body to the cooling water introduction port side, the right side wall portion and the left side wall portion being formed respectively so as to extend upward from right and left ends of the bottom wall, the front wall portion being connected to the bottom wall portion and the right and left side wall portions and being positioned so as to face the outer face of the spacer body, the water jacket spacer being assembled so as to have a gap on at least one side of the water jacket spacer, each gap being between the water jacket spacer and one of an inner wall portion and an outer wall portion of the water jacket.

2. The water jacket spacer as set forth in claim 1, wherein the rectification portion is provided in the vicinity of the cooling water introduction port.

3. The water jacket spacer as set forth in claim 2, wherein a width of the rectification portion, orthogonal to a depth direction of the water jacket and along a face on the cooling water introduction port side of the spacer body, is greater than that of the cooling water introduction port.

4. The water jacket spacer as set forth in claim 2, wherein the rectification portion is configured in such a manner that a part of the rectification portion is located in the cooling water introduction port.

5. The water jacket spacer as set forth in claim 2, wherein the spacer body is configured to cover a whole of the water jacket in a depth direction.

6. The water jacket spacer as set forth in claim 1, wherein a width of the rectification portion, orthogonal to a depth direction of the water jacket and along a face on the cooling water introduction port side of the spacer body, is greater than that of the cooling water introduction port.

7. The water jacket spacer as set forth in claim 6, wherein the spacer body is configured to cover a whole of the water jacket in a depth direction.

8. The water jacket spacer as set forth in claim 1, wherein the rectification portion is configured in such a manner that a part of the rectification portion is located in the cooling water introduction port.

9. The water jacket spacer as set forth in claim 8, wherein the spacer body is configured to cover a whole of the water jacket in a depth direction.

10. The water jacket spacer as set forth in claim 1, wherein the spacer body is configured to cover a whole of the water jacket in a depth direction.

* * * * *